US009307889B1

(12) United States Patent
Daniel

(10) Patent No.: US 9,307,889 B1
(45) Date of Patent: Apr. 12, 2016

(54) HEATED DOORMAT WITH AT LEAST ONE OR MORE REMOVABLE BATTERY PACKS

(71) Applicant: Isaac S. Daniel, Miramar, FL (US)

(72) Inventor: Isaac S. Daniel, Miramar, FL (US)

( * ) Notice: Subject to any disclaimer, the term of this patent is extended or adjusted under 35 U.S.C. 154(b) by 144 days.

(21) Appl. No.: 13/746,248

(22) Filed: Jan. 21, 2013

Related U.S. Application Data

(63) Continuation-in-part of application No. 29/414,772, filed on Mar. 2, 2012, now Pat. No. Des. 674,641.

(51) Int. Cl.
*H05B 1/00* (2006.01)
*A47L 23/26* (2006.01)

(52) U.S. Cl.
CPC ..... *A47L 23/266* (2013.01)

(58) Field of Classification Search
CPC ..... H05B 3/06; H05B 3/00; H05B 3/28; H05B 3/36; H05B 3/44; H05B 3/46; H05B 3/48; H05B 3/54; H05B 3/56; H05B 3/40; H05B 2203/003; H05B 2203/017; H05B 2203/026; H05B 2203/014; H05B 2203/011; H05B 2203/013; H05B 2203/005; H05B 2203/033; H05B 2214/02; E01C 11/265; F24D 13/024
See application file for complete search history.

(56) References Cited

U.S. PATENT DOCUMENTS

| | | | | |
|---|---|---|---|---|
| 6,723,967 | B2 * | 4/2004 | Rock et al. | 219/528 |
| 2004/0245234 | A1 * | 12/2004 | Gehring | 219/213 |
| 2009/0050617 | A1 * | 2/2009 | Paris et al. | 219/213 |

* cited by examiner

*Primary Examiner* — Shawntina Fuqua
(74) *Attorney, Agent, or Firm* — Carol N. Green Kaul, Esq.

(57) ABSTRACT

The present invention relates to a doormat adapted for outdoor use for melting snow and ice accumulations comprising of a base including a mat element and a bottom portion for engaging with a supporting surface, wherein the mat element is configured for housing heating pipes in electrical engagement with each other that are disposed between the mat element and an upper surface element; at least one removable battery pack, removably attached to the doormat by an electronic port, wherein the heating pipes are powered by removable battery packs connected to the doormat via Universal Serial Bus ("USB") ports and as such providing for individualized charging of each removable battery pack; and the upper surface element comprising of a brush member with at least one or more apertures for providing access to the removable battery pack for charging the heating pipes disposed within.

11 Claims, 3 Drawing Sheets

HEATED DOORMAT WITH AT LEAST ONE OR MORE REMOVABLE BATTERY PACKS

PRIORITY CLAIM

This patent application is a non-provisional patent application and claims priority under 35 U.S.C. §119(e) to: U.S. Design patent application Ser. No. 29/414,772 titled Doormat, filed Mar. 2, 2012, which is hereby incorporated by reference as if fully stated herein.

FIELD OF THE INVENTION

The present invention relates to a doormat adapted for outdoor use for melting snow and ice accumulations comprising of a base including a mat element and a bottom portion for engaging with a supporting surface, wherein the mat element is configured for housing heating pipes in electrical engagement with each other that are disposed between the mat element and an upper surface element; at least one removable battery pack, removably attached to the doormat by an electronic port, wherein the heating pipes are powered by removable battery packs connected to the doormat via Universal Serial Bus ("USB") ports and as such providing for individualized charging of each removable battery pack; and the upper surface element comprising of a brush member with at least one or more apertures for providing access to the removable battery pack for charging the heating pipes disposed within.

BACKGROUND

The problem of personal safety in navigating accumulated snow and ice at entrance ways have persisted with various solutions posited over the years. For example, U.S. Pat. No. 4,967,057 to Bayless et al. teaches "[i]ndividual electrically heated mats, self-regulated by use of an electrical element whose resistance varies proportionately with its temperature, used for covering walking areas to prevent accumulation of snow and ice. Each mat is provided with male and female electrical connections on the ends of short power cords to permit any number of mats to be chained together in electrical parallel and to be used to cover, for example, a flight of stairs by positioning one mat on each stair." Bayless Abstract.

U.S. Pat. No. 6,180,929 to Pearce teaches a "lightweight flexible electrical heating device for melting snow and ice that may be cut in the field to custom length. The device includes a planar flexible electric heater sandwiched between two vulcanized polymer protective sheets. The heater include an array of resistive heating pipes s electrically connected in parallel and oriented substantially across the device length, allowing the heater to be cut to any length as needed. Potentially the outside surfaces is equipped with a ribbed non skid pattern that form an array of ribs and channels to increase traction and aid in water drainage." Pearce Abstract.

These solutions generally require an electrical energy source generally derived from a main building or consistent electrical connection in order to work. However, in the event of power failure the disclosed devices will not work as the heating pipes lacks a power source. Thus there still exists the need to be able to have the doormat powered with alternate power in the event of power failure and able to warm itself without in an unplugged state.

This invention satisfies these long felt needs in a new and novel manner and solves the foregoing problems that the prior art has been unable to resolve.

SUMMARY

An object of the present invention is to provide a safe, doormat suitable for warming by electrical heat and eliminating ice and snow on doorways, driveways and other similar surfaces requiring snow and ice removal.

Another object of the invention is to create an environmentally sealed heated doormat that may be exposed to the elements for extended periods of time while applied to objects and surfaces requiring protection from snow and ice accumulations.

The invention relates to a doormat comprising of a base including a mat element and a bottom portion for engaging with a supporting surface, wherein the mat element is configured for housing heating pipes in electrical engagement with each other that are disposed between the mat element and an upper surface element; at least one removable battery pack, removably attached to the doormat by an electronic port, wherein the at least one or more removable battery packs include a charging circuit and a heating circuit to generate heat when activated and a temperature control element operatively connected to the heating pipes to control activation of the heating pipes depending on the temperature, wherein the temperature control element being located inside the removable removable battery pack; and the upper surface element comprising of a brush member with at least one or more apertures for providing access to the removable battery pack for heating and charging the heating pipes disposed within.

The heating circuit is powered by the at least one removable battery pack or an electrical power cable, where the heat is distributed electrically along the heating pipes. The at least one removable battery pack is configured for connection to a power source independent from the doormat. Doormat also includes a sealing bracket having a substantially rectangular cutout dimensioned to receive the electronic port for the rechargeable removable battery packs to be removable attached thereto. The sealing bracket is attached with sealing means for bonding the upper surface to the mat element securing the heating pipes within thereby preventing exposure from weather hazards, and injury due to electrocution.

In some embodiments, the heating pipes are disposed in a grid formation, where the grid formation comprises of the heating pipes running longitudinally and horizontally.

Mat element includes a plate with a recessed portion configured for receiving the heating pipes and a portion of the removable battery pack. The mat element includes a plate with a recessed portion configured for receiving the heating pipes and the at least one or more removable battery packs to be fitted therein. It is understood that the heating pipes' configuration will determine the shape of the recessed portion as the heating pipes necessarily must fit securedly within the recessed portion for safety reasons.

The upper surface element of the doormat comprises of a brush member that is securedly affixed to the plate and includes a pad comprising of a plurality of miniature monofilament elements for engaging at a minimum the lower surface of a shoe or bare feet. The monofilament elements may be made of synthetic waterproof materials as were well known and used in the arts.

For a further and more fully detailed understanding of the present invention, various objects and advantages thereof, reference is made to the following detailed description and the accompanying drawings.

Additional objectives of the present invention will appear as the description proceeds.

The foregoing and other objects and advantages will appear from the description to follow. In the description, references are made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

DESCRIPTION OF THE DRAWINGS

A Heated Doormat With At least One or More Removable Battery Packs of which the following is the specification with reference being made to the accompanying drawings forming a part hereof.

DETAILED DESCRIPTION OF PREFERRED EMBODIMENTS

Figure 1:
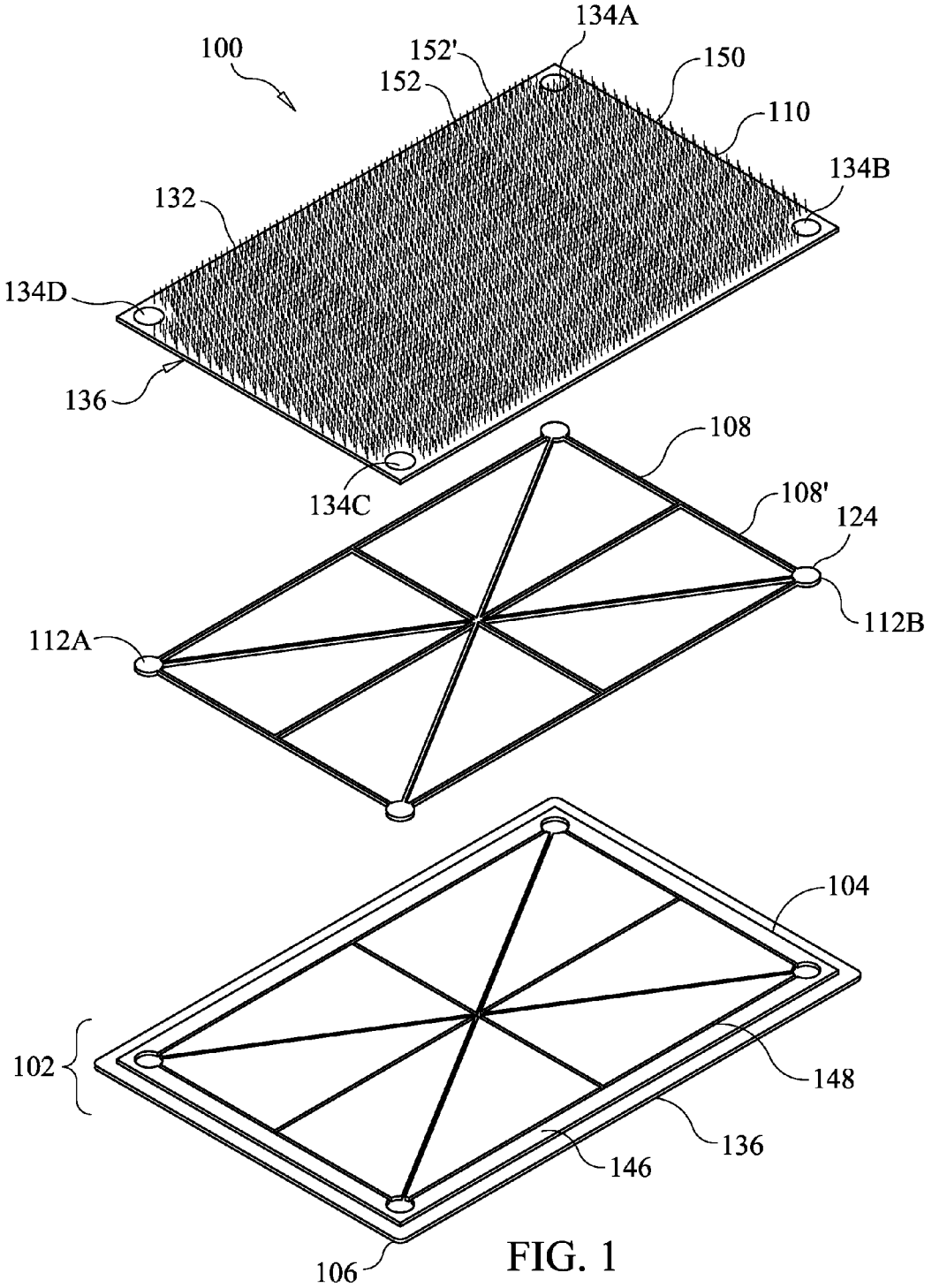
FIG. 1 is a view of a doormat with removable battery packs according to one embodiment of the invention.

The following discussion describes in detail an embodiment of the doormat as described below. However, this discussion should not be construed, as limiting the invention to those particular embodiments, as practitioners skilled in the art will appreciate that the doormat may vary as to configuration and as to details of the parts, without departing from the basic concepts as disclosed herein. Similarly, the elements described herein may be implemented separately, or in various combinations without departing from the teachings of the present invention. For definition of the complete scope of the invention, the reader is directed to appended claims. Turning now descriptively to the drawings, in which similar reference characters denote similar elements throughout the several views.

FIG. 1 is a view of a doormat 100 with a base 102 including a mat element 104 and a bottom portion 106 for engaging with a supporting surface, wherein the mat element 104 is configured for housing heating pipes 108, 108' in electrical engagement and interconnected with each other, that are disposed between the mat element 104 and an upper surface element 110; at least one removable battery pack 112A, removably attached to the doormat 100 by an electronic port 114, wherein the at least one removable battery pack 112 includes a charging circuit 116 and a heating circuit 118 to generate heat when activated and a temperature control element 120 operatively connected to a heating pipes 108, 108' to control activation and heating of the heating pipes 108, 108' depending on the temperature; and a pressure sensor 124 that are well known and used in the arts, operatively connected to the temperature control element 120 and the heating pipes 108, 108' to activate the heating circuit 118 based on applied pressure e.g. weight of an individual or fallen snow; a power switch 126 being located on the exterior 128 of the removable battery pack 112 in electrical engagement with the charging and heating circuits 116, 118, respectively that may also derive power from a power cable 130; and the upper surface element 110 comprising of a brush member 132 with at least one or more apertures 134A, 134 B, 134C, 134D for providing access to the one or a plurality of removable battery packs 112A, 112B, 112C, 112D for charging the heating pipes 108 disposed within.

Figure 2:
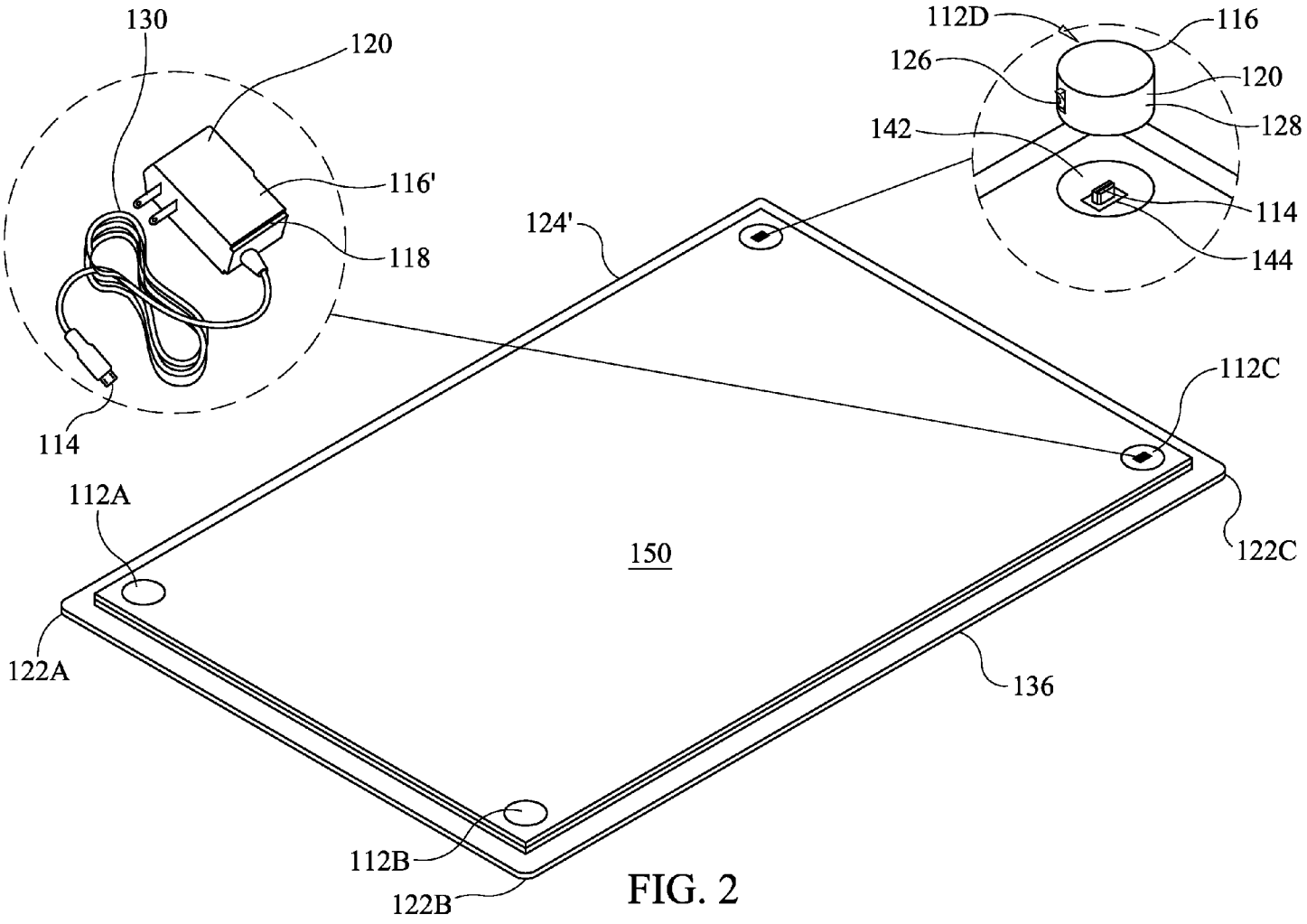
FIG. 2 is a view of the interior structure of the doormat according to one embodiment of the invention.

As shown in FIGS. 1 & 2, the upper surface element 116 comprises of a brush member 132 with at least one or more apertures 134A, 134B, for providing access to the electronic port 114, i.e. Universal Serial Bus ("USB") ports as are well known and used in the arts, for the at least one or more removable battery packs 112A, 112B, 112C, 112D to be removably attached to the doormat 110. Removable battery packs 112A, 112B, 112C, 112D are configured for connection to a power source independent from the doormat 100 e.g. an electrical power outlet via a power cable 130 adapted at one end with a USB port 114 and an electrical charger at the opposing end configured with a charging circuit 116' contained therein for recharging the removable battery pack 112. In this manner, the removable battery packs 112A, 112B, 112C, 112D may be recharged individually to operate as a power source for heating the doormat 100.

It is understood that the doormat 100 may be configured in any geometrical shape, i.e. oblong, rectangle, square, circle, rhombus, triangle and the like. Accordingly, the heating pipes 108, 108' within may be configured in any array or geometric configuration to accommodate the shape of the doormat 100. In one embodiment, the doormat 102 is configured in a rectangular shape and the removable battery packs 112A, 112B, 112C, 112D are disposed at or substantially near the outer perimeter 136 of the rectangle shaped doormat 100. In the exemplary embodiment shown in FIGS. 1 & 2, the doormat 100 includes four apertures 134A, 134B, 134C, 134D disposed at or near the four corners 122A, 122B, 122C, 122D of the exemplary rectangular shaped doormat 100, sized and dimensioned to receive the removable battery packs 112A, 112B, 112C, 112D that are electrically connected via an electronic port 114, e.g. USB ports that are well known and used in the arts. Although the removable battery packs 112A, 112B, 112C, 112D as shown are disposed at or near the four corners 122A, 122B, 122C, 122D of the outer perimeter 136 but it is understood that the removable battery packs 112A, 112B, 112C, 112D could easily have been disposed in any other location along the doormat for providing a source of heat as long as they are in electrical communication with the heating pipes 108, 108' positioned within the doormat 100.

The heating circuit 118 is powered by the at least one or more removable battery packs 112A, 112B, 112C, 112D or an electrical power cable 130 and may include a power switch 126 as are well known and used in the arts to power on a device, e.g. the removable battery packs 112A, 112B, 112C, 112D such that they can start heating the doormat 100 or derive power as they are being recharged.

In some embodiments, the electrical power cable 130 includes a charging circuit 116' and a heating circuit 118' to generate heat when activated and a temperature control element 120' to cyclically control activation and heating of the doormat's heating pipes 108, 108' based on the temperature, such that when the power cable 130 is plugged into an electrical power source the doormat 100 is heated and is available for use without requiring that the doormat 100 to remain consistently plugged in. In this manner, electrocution and shock are minimized.

Doormat 100 includes at least one or more sealing brackets 142A, 142B, 142C, 142D each having a substantially rectangular cutout 144 dimensioned to receive an electronic port 114 for the rechargeable removable battery packs 112A, 112B, 112C, 112D to be removable attached thereto. Each sealing bracket 142A is attached with sealing means for bonding the upper surface 110 to the mat element 104 securing the heating pipes 108, 108' within thereby preventing exposure from weather hazards, and injury due to electrocution.

In an exemplary embodiment, the heating pipes 108, 108' may be disposed in a grid formation, e.g. running longitudinally and/or horizontally and/or in a crisscross pattern interconnected to each other. The heating pipes 108, 108' are further disposed in between the mat element 104 for generating heat along the upper surface area 110 of the doormat 100. The heating pipes 108, 108' are preferably a thermoresistive element that produces heat when electricity flows through it. The heating pipes 108, 108' are also preferably configured to be rounded, e.g. like a coil so as to allow ease of manufacturing since the heating pipes includes electrical wires which are themselves generally rounded.

The temperature control element 120 functions as a cyclic temperature-dependent power control element to provide temperature control and safe operation of the invention. Temperature control element may be a thermostat, or temperature sensor which may be either preset or adjustable to allow user the ability to control the amount of heat produced by the heating pipes 108, 108'. When the heating pipes 108, 108' reaches a desired set temperature, e.g., between 45 degrees, the thermostat or temperature sensor disconnects power to the heating pipes 108, 108' and stop further heating. When the temperature falls below the set temperature, the thermostat again closes the heating circuit 118 to reconnect power to the heating pipes 108, 108' and resume heating the doormat 100. In an alternate embodiment, the temperature control element 120 may be a variable resistive element set to control the amount of electrical power through the heating pipes 108, 108'.

Figure 3:
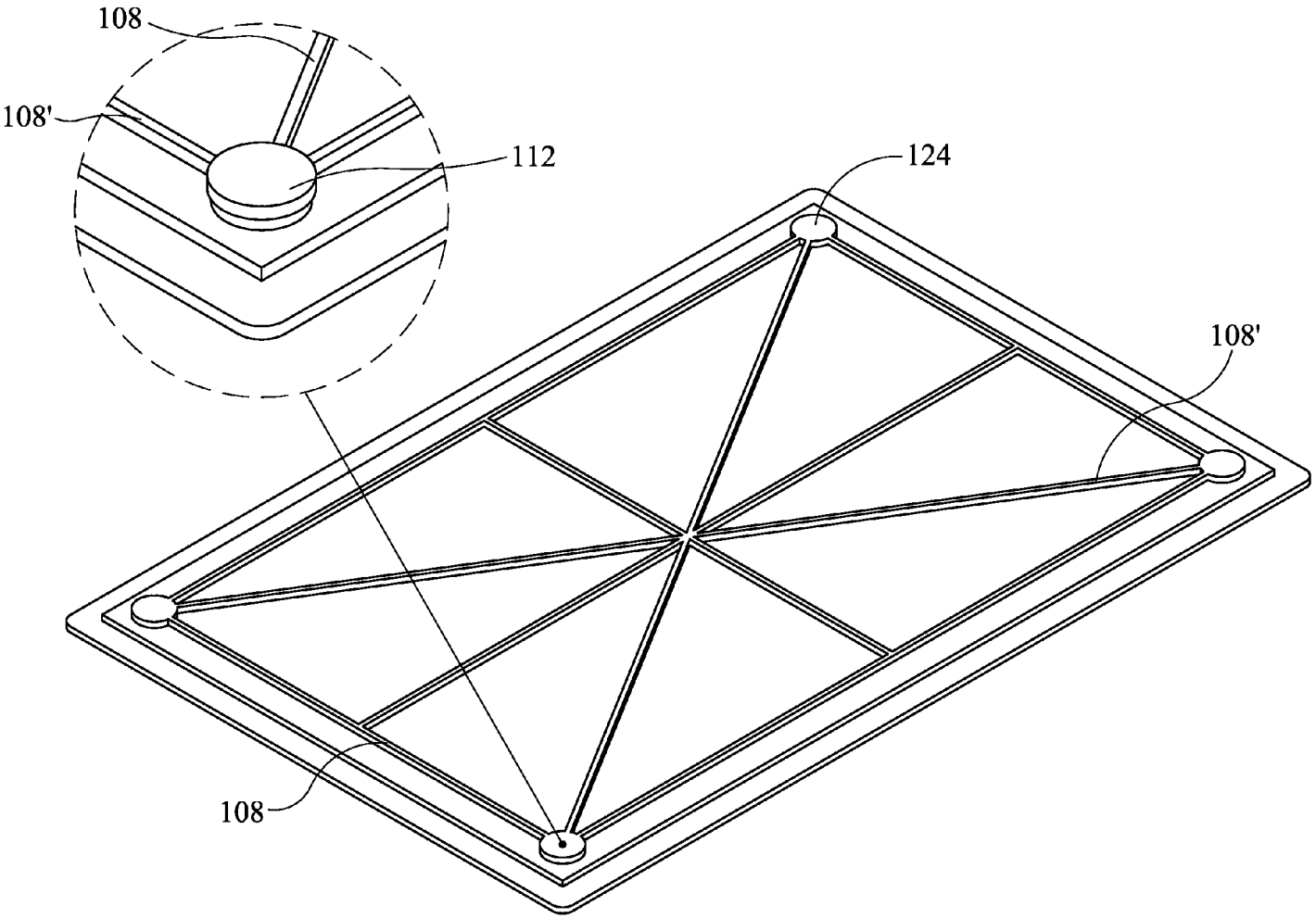
FIG. 3 is an exploded view of the doormat according to one embodiment of the invention.

FIG. 3 is a view of the doormat 100 according to one embodiment of the invention. In some embodiments, doormat 102 includes at least one or more pressure sensors 124, 124' such that it will sense a certain amount of pressure for example, a footfall or body weight causing the doormat 100 to produce heat through the heating pipes 108, 108' to eliminate any snow that would otherwise have been tracked from the outdoor to indoors. The at least one pressure sensor 124 may be calibrated to detect light objects, e.g. an grown man's weight but still be sensitive enough to detect an inch of snowfall.

The mat element 104 includes a plate 146 with a recessed portion 148 configured for receiving the heating pipes 108, 108' and the at least one or more removable battery packs 112, 112' to be fitted therein. It is understood that the heating pipes' 106, 106' configuration will determine the shape of the recessed portion 148 or vice versa as the heating pipes 108, 108' necessarily must securedly fit within the recessed portion 148 for safety reasons.

The upper surface element 116 of the doormat 102 comprises of a brush member 116 that is securedly affixed to the plate 146 and said brush member 116 includes a pad 150 comprising of a plurality of miniature monofilament elements 152, 152', 152" for engaging the lower surface of a shoe or bare feet and/or any other surface that comes in contact with the doormat 100. The miniature monofilament elements 152, 152', 152" may be made of synthetic waterproof materials made of plastic or resin as were well known and used in the arts.

The principles of the present disclosure may be applied to all types of computers, systems, and the like, include desktop computers, servers, notebook computers, personal digital assistants, microcomputers, and the like. However, the present disclosure may not be limited to the personal computer.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A doormat comprising of:

a base including a mat element and a bottom portion for engaging with a supporting surface, wherein the mat element is configured for housing heating pipes in electrical engagement with each other that are disposed between the mat element and an upper surface element;

at least one removable battery pack, removably attached to the doormat by an electronic port, wherein the at least one removable battery pack includes a charging circuit and a heating circuit to generate heat when activated and a temperature control element operatively connected to the heating pipes to control activation of the heating pipes depending on the temperature, wherein the temperature control element being located inside the removable battery pack;

a pressure sensor connected to the temperature control element and the heating pipes to activate the heating circuit based on applied pressure; and the upper surface element comprising of a brush member with at least one or more apertures for providing access to the removable battery pack for charging the heating pipes disposed within.

2. The doormat according to claim 1, wherein the heating circuit is powered by the at least one removable battery pack or an electrical power cable.

3. The doormat according to claim 1, wherein the at least one removable battery pack is configured for connection to a power source independent from the doormat.

4. The doormat of claim 1, wherein the doormat includes a sealing bracket having a substantially rectangular cutout dimensioned to receive the electronic port for the rechargeable removable battery packs to be removable attached thereto.

5. The doormat of claim 4, wherein a sealing bracket is attached with sealing means for bonding the upper surface to the mat element securing the heating pipes within thereby preventing exposure from weather hazards, and injury due to electrocution.

6. The doormat according to claim 1, wherein the heating pipes are disposed in a grid formation.

7. The doormat according to claim 3, wherein the grid formation comprises of the heating pipes running longitudinally and horizontally.

8. The doormat according to claim 1, wherein the heat is distributed electrically along the heating pipes.

9. The doormat according to claim 1, wherein the mat element includes a plate with a recessed portion configured for receiving the heating pipes and a portion of the removable battery pack.

10. The doormat according to claim 1, wherein the brush member is securedly affixed to a plate.

11. The doormat according to claim 1, wherein the brush member includes a pad comprising of a plurality of miniature monofilament elements.

* * * * *